US006698682B1

(12) United States Patent
Roderick

(10) Patent No.: US 6,698,682 B1
(45) Date of Patent: Mar. 2, 2004

(54) MOBILE WIRE DISPENSING APPARATUS

(76) Inventor: Roger W. Roderick, 2934 Sunrise Rd., Lady Lake, FL (US) 32159

( * ) Notice: Subject to any disclaimer, the term of this patent is extended or adjusted under 35 U.S.C. 154(b) by 0 days.

(21) Appl. No.: 10/292,937

(22) Filed: Nov. 13, 2002

(51) Int. Cl.[7] ..... B65H 49/32
(52) U.S. Cl. ..... 242/557; 242/594.4
(58) Field of Search ..... 242/557, 594.4, 242/594.3, 594.5, 594.6, 594; 280/47.18, 47.19, 47.24, 47.27, 47.28, 47.29

(56) References Cited

U.S. PATENT DOCUMENTS 1,509,717 A * 9/1924 Davis ..... 242/557
3,134,555 A * 5/1964 Baker ..... 242/557
3,603,526 A * 9/1971 Payne ..... 242/129.8
3,854,509 A * 12/1974 Bailey ..... 242/557
3,990,653 A * 11/1976 Marcell ..... 242/129.8
D268,960 S * 5/1983 Havlick ..... D34/26
4,391,422 A * 7/1983 McDonald ..... 242/557
D341,238 S * 11/1993 Sloan ..... D34/18
5,285,981 A * 2/1994 Pavelka ..... 242/557
5,316,232 A * 5/1994 Lambert ..... 242/129
5,509,671 A * 4/1996 Campbell ..... 242/557
5,915,646 A * 6/1999 Campbell ..... 242/594.4

* cited by examiner

*Primary Examiner*—John M. Jillions

(57) ABSTRACT

A mobile wire dispensing apparatus for carrying and moving spools of wire to desired locations. The mobile wire dispensing apparatus includes a frame including tubullar members and also including connectors interconnecting said tubular members; and also includes wheels upon which the frame is mounted; and further includes handle members being connected to the frame; and also includes a support stand assembly being connected to the frame; and further includes wire-carrying spools being removably mounted to said frame.

6 Claims, 5 Drawing Sheets

MOBILE WIRE DISPENSING APPARATUS

BACKGROUND OF THE INVENTION

1. Field of the Invention

The present invention relates to mobile wire dispensers and more particularly pertains to a new mobile; wire dispensing apparatus for carrying and moving spools of wire to desired locations.

2. Description of the Prior Art

The use of mobile wire dispensers is known in the prior art. More specifically, mobile wire dispensers heretofore devised and utilized are known to consist basically of, familiar, expected and obvious structural configurations, notwithstanding the myriad of designs encompassed by the crowded prior art which have been developed for the fulfillment of countless objectives and requirements.

Known prior art includes U.S. Pat. No. 3,603,526; U.S. Pat. No. 5,285,981; U.S. Pat. No. 5,316,232; U.S. Pat. No. 3,990,653; U.S. Pat. No. 5,915,646; and U.S. Pat. No. Des. 268,960.

While these devices fulfill their respective, particular objectives and requirements, the aforementioned patents do not disclose a new mobile wire dispensing apparatus. The prior art discloses inventions having carts with spools being mounted to brackets upon the carts.

SUMMARY OF THE INVENTION

The general purpose of the present invention, which will be described subsequently in greater detail, its to provide a new mobile wire dispensing apparatus which has many of the advantages of the mobile wire dispensers mentioned heretofore and many novel features that result in a new mobile wire dispensing apparatus which is not anticipated, rendered obvious, suggested, or even implied by any of the prior art mobile wire, dispensers, either alone or in any combination thereof. The present invention includes a frame including tubular members and also including connectors interconnecting said tubular members; and also includes wheels upon which the frame is mounted; and further includes handle members being connected to the frame; and also includes a support stand assembly being connected to the frame; and further includes wire-carrying spools being removably mounted to said frame. None of the prior art includes the combination of the elements of the present invention.

There has thus been outlined, rather, broadly, the more important features of the mobile wire dispensing apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new mobile wire dispensing apparatus which has many of the advantages of the mobile wire dispensers mentioned heretofore and many novel features that result in a new mobile wire dispensing apparatus which is not anticipated, rendered obvious, suggested, or even implied by any of the prior art mobile wire dispensers, either alone or in any combination thereof.

Still another object of the present invention is to provide a new mobile wire dispensing apparatus for carrying and moving spools of wire to desired locations.

Still yet another object of the present invention is to provide a new mobile wire dispensing apparatus that is easy and convenient to set up and use.

Even still another object of the present invention is to provide a new mobile wire dispensing apparatus that allows for multiple spools carrying various grades of wire to be moved about for access thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
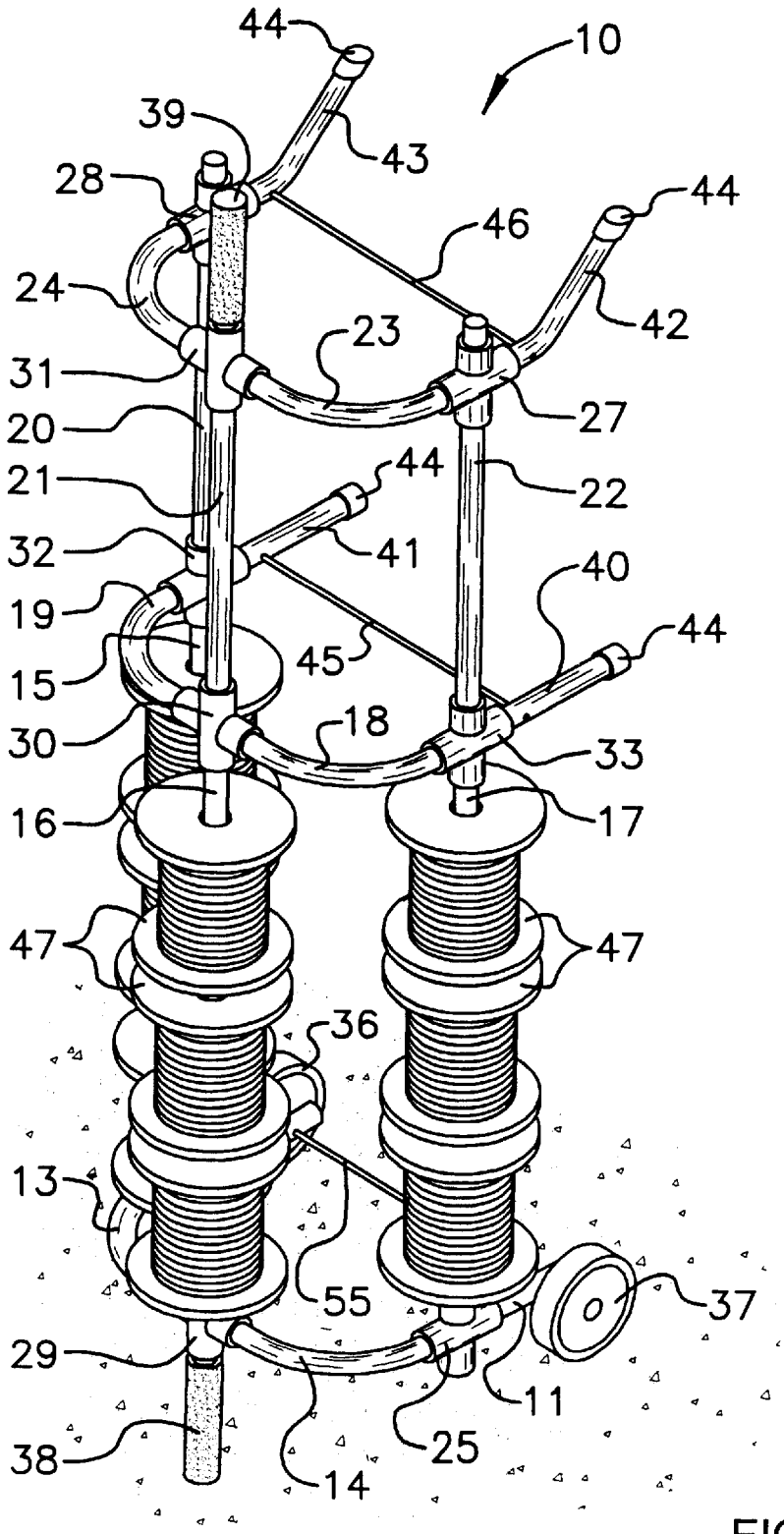
FIG. 1 is a perspective view of a new mobile wire dispensing apparatus according to the present invention.
Figure 2:
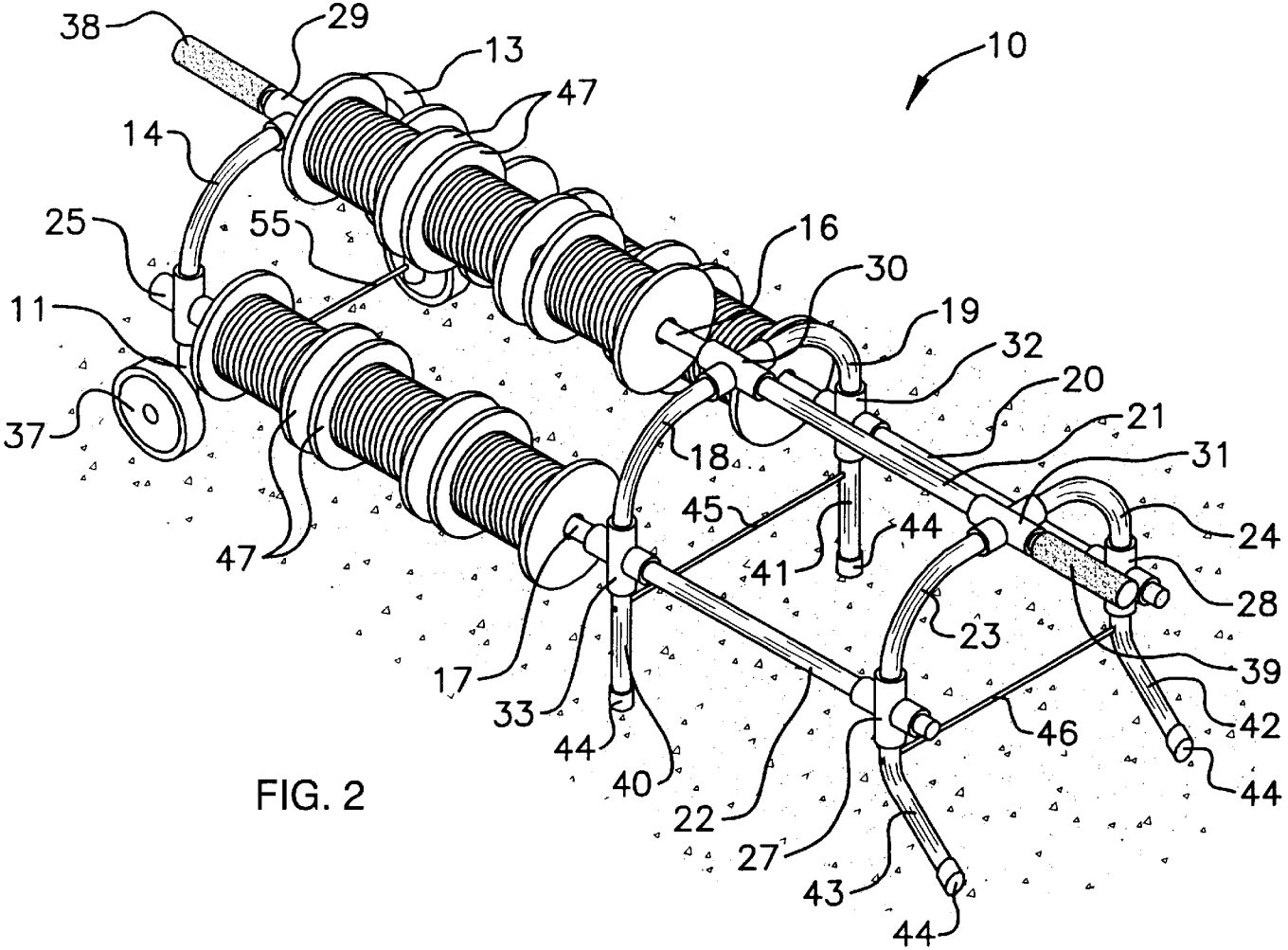
FIG. 2 is another perspective view of the present invention.
Figure 3:
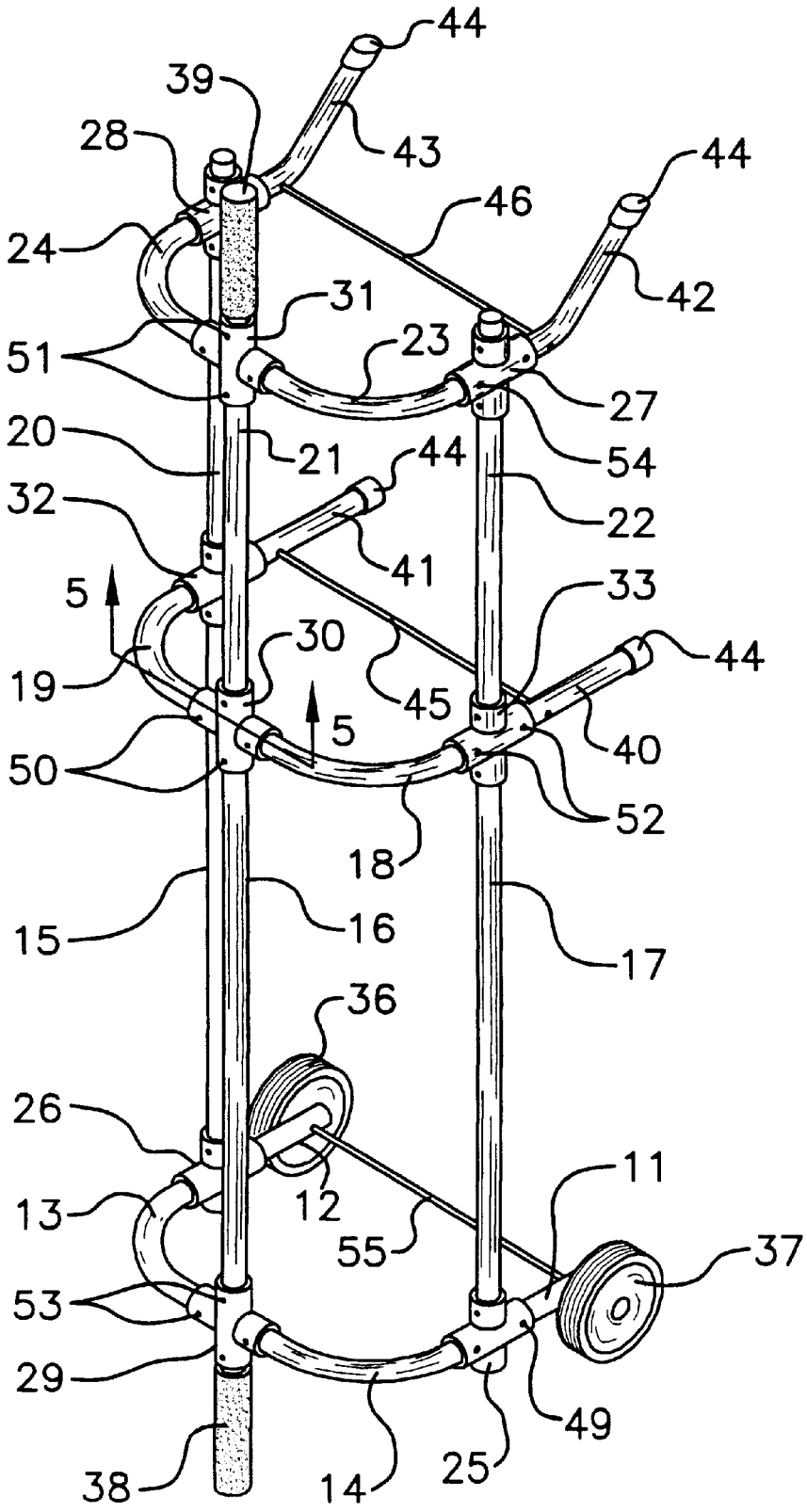
FIG. 3 is a perspective view of the dolly of the present invention.
Figure 4:
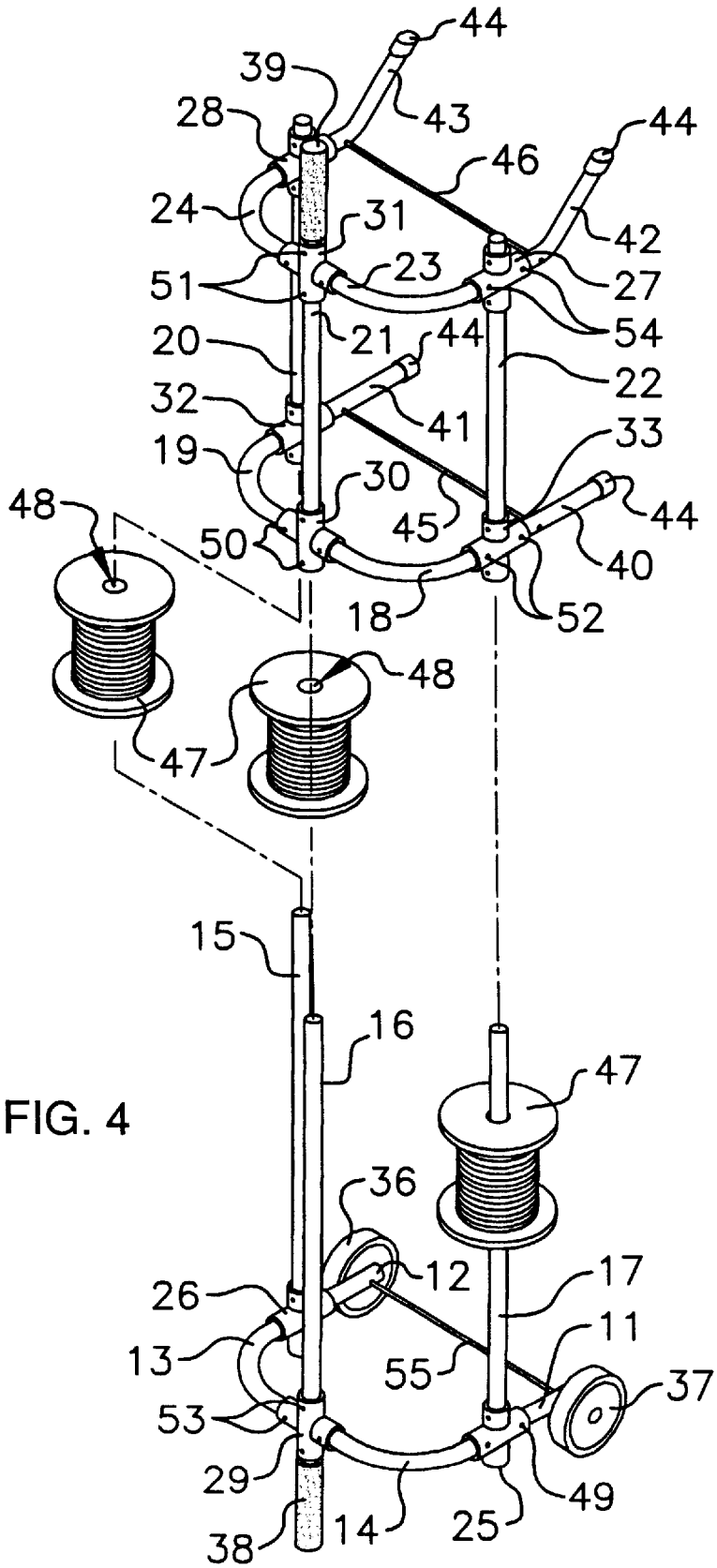
FIG. 4 is an exploded perspective view of the present invention.
Figure 5:
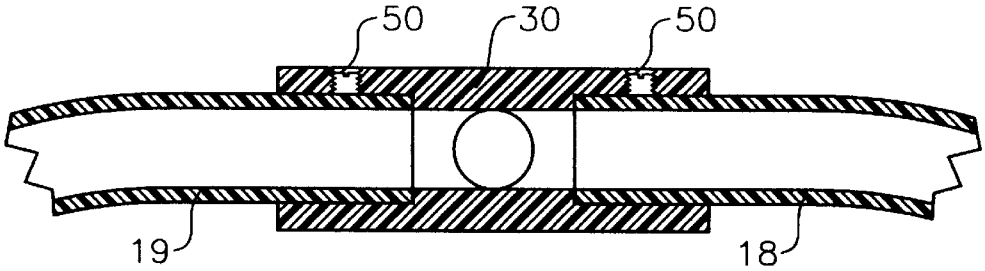
FIG. 5 is a partial cross-sectional view of the present invention.

With reference now to the drawings and in particular to FIGS. 1 through 5 thereof, a new mobile; wire dispensing apparatus embodying the principles and concepts of the present invention and generally designated by the& reference numeral 10 will be described.

As best illustrated in FIGS. 1 through 5, the mobile wire dispensing apparatus 10 generally comprises a frame 11–33 including tubular members 11–24 and also, including connectors 25–33 conventionally interconnecting the tubular members 11–24. The tubular members 11–24 include wheel support members 11,12, and also include curved first support members 13,14 being connected to the wheel support members 11,12, and further include elongate first support members 15–17 being connected to the curved first support members 13,14, and also include curved second support members 18,19 being connected to the elongate first support members 15–17, and further include elongate second support members 20–22 being connected to the curved second support members 18,19, and also include curved third support members 23,124 being connected to the elongate second support members 20–22, and further include a cross member 55 conventionally interconnecting the wheel support members 11,12. The connectors 25–33 include first four-way tubular connectors 25,26 conventionally interconnecting with first fasteners 49 to the wheel support members 11 ,12, the curved first support members 13,14, and a plurality of the elongate first support members 15,17; and also include second four-way tubular connectors 27,28 conventionally interconnecting with fastener members 54 to the curved third support members 23,24 and a plurality of the elongate second support members 20,22; and further include a third four-way tubular connector 29 conventionally interconnecting with fastening members 5;3 to the curved first support members 13,14 and to one of the Elongate first support members 16; and also include a fourth four-way tubular connector 30 conventionally interconnecting with second fasteners 50 to the curved second support members 18,19, one of the elongate first support members 16, and one of the elongate second support members 21; and further include a fifth four-way tubular connector 31 conventionally interconnecting with third fasteners 51 to one of the elongate second support members 21 and to the curved third support members 23,24; and also included sixth four-way tubular connectors 32,33 each conventionally interconnecting with fourth fasteners 52 to a respective one of the elongate second support members 20,22 and to a respective one of the curved second support members 18,19 and to a respective one of the elongate first support members 16. Wheels 36,37 upon which the frame 11–33 is mounted are conventionally mounted at ends of the wheel support members 11,12.

Handle members 38,39 are conventionally connected to the frame 11–33. The handle members 38,39 include a first handle member 38 being conventionally fastened to the third four-way tubular connector 29 for supporting the mobile wire dispensing apparatus 10 in an upright position upon a surface, and also include a second handle member 39 being conventionally fastened to the fifth four-way tubular connector 31.

A support stand assembly is conventionally connected to the frame 11–33. The support stand assembly includes elongate first stand members 40,41 being conventionally fastened to the sixth four-way tubular connectors 32,33, and also includes curved second stand members 42,43 being conventionally fastened to the second four-way tubular connectors 27,28 to allow the mobile wire dispensing apparatus 10 to be disposed horizontally upon a surface; and further includes braces 45,46 one of which conventionally interconnects the elongate first stand members 40,41 and another of which interconnects the curved second stand members 42,43; and also includes rubberized end-cap members 44 being conventionally attached at ends of the curved second stand members 42,43 and the elongate first stand members 40,41.

Wire-carrying spools 47 are removably mounted to the frame 11–33. The wire-carrying spools 47 have; bores 48 being disposed therethrough and are rotatably mounted about the elongate first support members 15–17.

In use, the user removes the third and fourth four-way tubular connectors 31–33 from the elongate first support members 15–17 and mounts the wire-carrying spools 47 about the elongate first support members 15–17, and then fastens the fifth and sixth four-way tubular connectors 31–33 to the elongate first support members 15–17, and the user grasps the second handle member 39 to roll the mobile wire dispensing apparatus 10 to the desired location. Thereupon, the user places the mobile wire dispensing apparatus 10 horizontally upon a surface so that the user can let out the wire from the wire-carrying spools 47. Once finished, the user again sets the mobile wire dispensing apparatus 10 upright so that it can again be moved as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationship s for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the mobile wire dispensing apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mobile wire dispensing apparatus comprising:

a frame including tubular members and also including connectors interconnecting said tubular members, said tubular members including wheel support members, and also including curved first support members being connected to said wheel support members, and further including elongate first support members being connected to said curved first support members, and also including curved second support members being connected to said elongate first support members, and further including elongate second support members being connected to said curved second support members, and also including curved third support members being connected to said elongate second support members, and further including a cross member interconnecting said wheel support members;

wheels upon which said frame is mounted;

handle members being connected to said frame;

a support stand assembly being connected to said frame; and wire-carrying spools being removable mounted to said frame.

2. A mobile wire dispensing apparatus as described in claim 1, wherein said connectors include first four-way tubular connectors interconnecting with first fasteners to said wheel support members, said curved first support members, and a plurality of said elongate first support members; and also include second four-way tubular connectors interconnecting with fastener members to said curved third support members and a plurality of said elongate second support members; and further include a third four-way tubular connector interconnecting with fastening members to said curved first support members and to one of said elongate first support members; and also include a fourth four-way tubular connector interconnecting with second fasteners to said curved second support members, to one of said elongate first support members, and to one of said elongate second support members; and further include a fifth four-way tubular connector interconnecting with third fasteners to one of said elongate second support members and to said curved third support members; and also include sixth four-way tubular connectors each interconnecting with fourth fasteners to a respective one of said elongate second support members and to a respective one of said curved second support members and to a respective one of said elongate first support members.

3. A mobile wire dispensing apparatus as described in claim 2, wherein said wheels are mounted at ends of said wheel support member.

4. A mobile wire dispensing apparatus as described in claim 3, wherein said handle members include a first handle member being fastened to said third four-way tubular connector for supporting said mobile wire dispensing apparatus in an upright position upon a surface, and also include a second handle member being fastened to said fifth four-way tubular connector for supporting said mobile wire dispensing apparatus in a horizontal position upon the surface.

5. A mobile wire dispensing apparatus as described in claim 4, wherein said support stand assembly includes elongate first stand members being fastened to said sixth four-way tubular connectors, and also includes curved second stand members being fastened to said second four-way tubular connectors to allow said mobile wire dispensing apparatus to be disposed horizontally upon a surface; and further includes braces one of which interconnects said elongate first stand members and another of which interconnects said curved second stand members; and also includes rubberized end-cap members being attached at ends of said curved second stand members and said elongate first stand members.

6. A mobile wire dispensing apparatus as described in claim 5, wherein said wire-carrying spools leave bores being disposed therethrough and are rotatably mounted about said elongate first support members.

* * * * *